US006282965B1

(12) United States Patent
French et al.

(10) Patent No.: US 6,282,965 B1
(45) Date of Patent: Sep. 4, 2001

(54) METHOD AND APPARATUS FOR DETECTING WASHING MACHINE TUB IMBALANCE

(75) Inventors: Alan P. French; John S. Thorn, both of Florissant, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/197,272

(22) Filed: Nov. 20, 1998

(51) Int. Cl.[7] ..... G01M 13/00
(52) U.S. Cl. ..... 73/660; 68/23.1
(58) Field of Search ..... 73/460, 462, 660; 68/23.1

(56) References Cited

U.S. PATENT DOCUMENTS

| | | | | |
|---|---|---|---|---|
| 4,517,695 | * | 5/1985 | Hoffmann et al. | 210/144 |
| 4,986,092 | | 1/1991 | Sood et al. | 68/12 |
| 4,991,247 | * | 2/1991 | Castwall et al. | 210/144 |
| 5,070,565 | | 12/1991 | Sood et al. | 8/159 |
| 5,561,993 | | 10/1996 | Elgersma et al. | 68/23.2 |
| 5,713,221 | | 2/1998 | Myers et al. | 68/12.06 |

FOREIGN PATENT DOCUMENTS

| | | |
|---|---|---|
| 4038178 | 6/1992 | (DE) . |
| 0523371 | 1/1993 | (EP) . |
| 0684334 | 11/1995 | (EP) . |
| 0792963 | 9/1997 | (EP) . |
| 0969133 | 1/2000 | (EP) . |
| 2271837 | 4/1994 | (GB) . |
| 2295160 | 5/1996 | (GB) . |

* cited by examiner

*Primary Examiner*—Richard A. Moller
(74) *Attorney, Agent, or Firm*—Howrey, Simon, Arnold & White LLP

(57) ABSTRACT

A method and system for detecting an imbalance condition in a rotating washing machine tub includes receiving an indication of the actual tub rotation speed, comparing the actual tub rotation speed to a predetermined desired rotation speed to calculate a speed error, and determining maximum and minimum speed errors. The difference between the maximum and minimum speed error is calculated, and a tub imbalance condition is detected based at least in part on the calculated difference. In one embodiment, the speed error is input to a controller that produces an output used to minimize the absolute speed error. The difference between the minimum and maximum controller output is then used to determine tub imbalance.

In another aspect of the invention, the method and system include receiving an indication of a power level required to achieve a given washing machine rotation speed and comparing the required power level to a predefined standard power level associated with the given rotation speed. A tub imbalance condition is detected in response to the comparison.

17 Claims, 4 Drawing Sheets

METHOD AND APPARATUS FOR DETECTING WASHING MACHINE TUB IMBALANCE

BACKGROUND OF THE INVENTION

1. Field of the Invention

This invention relates generally to clothes washing machines, and more particularly, to a method and system for detecting a tub imbalance condition in a washing machine.

2. Description of Related Art

Residential and commercial clothes washing machines are well known. A generally cylindrical tub or basket for holding the clothing and other articles to be washed is rotatably mounted within a cabinet. Typically, an electric motor drives the tub. During a wash cycle, water and detergent or soap are forced through the clothes to wash them. The detergent is rinsed from the clothes, then, during one or more spin cycles, the water is extracted from the clothes by spinning the tub.

One way of categorizing washing machines is by the orientation of the washing machine tub. Conventional, vertical-axis washing machines have the tub situated to spin about a vertical axis. Articles to be washed are loaded into the tub through a door, which is usually situated on the top of the washing machine. A vertical-axis washing machine tub includes an agitator situated therein, which cleans clothes by pushing and pulling them down into the water. A motor typically drives the agitator, in addition to spinning the vertically-oriented tub during spin cycles. The motor usually operates at a constant speed, and a series of gears or belts are configured to drive the proper component at the proper time during each washing machine cycle.

Horizontal-axis washing machines, having the tub oriented to spin about an essentially horizontal axis, do not include an agitator, and a variable-speed motor drives the tub. During wash cycles, the tub of the horizontal-axis washing machines rotates at a relatively low speed. The rotation speed of the tub is such that clothes are lifted up out of the water, using baffles distributed about the tub, then dropped back into the water as the tub revolves.

Both vertical and horizontal-axis washing machines extract water from clothes by spinning the tub, such that centrifugal force extracts water from the clothes. It is desirable to spin the tub at a high speed and extract the maximum amount of water from the clothes in the shortest possible time, thus saving time and energy. The distribution of the clothes about the periphery of the tub affects the washing machine's ability to spin the tub at a high speed.

Vertical-axis washing machines are especially susceptible to imbalance problems. Several factors contribute to this predicament. For instance, when a wash or rinse cycle completes and the water is drained from the tub, the clothes are gathered at the bottom of the tub, not distributed about the entire tub. In conventional washing machines, the tub typically is not perfectly cylindrical; but rather, includes a draft. When the tub spins, the clothes will "creep" up the sides of the tub. However, since a constant speed motor typically drives the vertically-oriented tub, the motor quickly ramps the tub up to the full spin speed. There is little chance for the clothes to distribute about the periphery of the tub, so they creep up the tub's sides in an unbalanced fashion.

The unbalanced, spinning tub vibrates within the cabinet. In conventional vertical-axis washing machines, if the vibration is too severe, the tub will trip a switch mounted inside the cabinet, stopping the tub's rotation and activating a tub-imbalance alarm. A user then manually redistributes the wet clothes within the tub, and restarts the spin cycle.

Horizontal-axis washing machines typically are less vulnerable to tub imbalances. As discussed above, the tub in a horizontal-axis machine is driven by a variable speed motor. This allows the inclusion of a "distribution" cycle, wherein the tub is rotated faster than the rotation speed of a wash cycle, but slower than in a spin cycle. The tub rotation speed is gradually increased, until the clothes begin to "stick" to the sides of the tub due to centrifugal force. The slower rotation speed allows the clothes to more evenly distribute about the sides of the tub. Once the clothes have been distributed about the tub, the speed is increased to a full spin speed to extract the water from the clothes.

Even though horizontal-axis washing machines may be less prone to tub imbalances, they are not immune to tub imbalance problems. If the clothes do not evenly distribute during the distribution cycle, the unbalanced load within the tub will cause unwanted vibrations as the tub rotates. Rather than applying all of the motor's power to spinning the tub at the highest possible speed, power is wasted in tub movement and cabinet vibrations.

Thus, it is desirable to detect the presence of an imbalance condition in a rotating tub, and take corrective action. However, prior art methods for detecting imbalance conditions have been largely unsatisfactory. The present invention addresses these, and other, shortcomings associated with the prior art.

SUMMARY OF THE INVENTION

In one aspect of the invention, a method of detecting an imbalance condition in a rotating washing machine tub includes receiving an indication of the actual tub rotation speed and comparing the actual tub rotation speed to a predetermined desired rotation speed to calculate a speed error. Maximum and minimum speed errors are determined, and the difference between the maximum and minimum speed errors is determined. A tub imbalance condition is detected based at least in part on the calculated difference.

In another aspect of the invention, a method of detecting an imbalance condition in a rotating washing machine tub includes receiving an indication of a power level required to achieve a given washing machine rotation speed and comparing the required power level to a predefined standard power level associated with the given rotation speed. A tub imbalance condition is detected in response to the comparison.

In yet another aspect of the invention, a system for detecting an imbalance condition for a rotating washing machine tub includes a processor and a memory accessible by the processor. The memory stores a rotation speed demand value. A speed detection device is adapted to indicate the rotation speed of the washing machine tub. The processor is programmed to compare the speed indicated by the speed detection device to the speed demand to calculate a speed error. The processor further is programmed to determine minimum and maximum speed errors, and calculate the difference between the maximum and minimum speed errors to detect an imbalance condition. In an alternative system, the memory stores a standard power level associated with a given rotation speed. The processor is programmed to calculate a power level required to achieve the given washing machine rotation speed indicated by the speed detection device, and compare the required power level to the predefined standard power level to detect a tub imbalance condition.

In a further aspect of the invention, a method of controlling a washing machine tub containing clothes being washed is presented. The method includes receiving an indication of a first tub rotation speed demand for a first operational cycle and receiving an indication of the actual tub rotation speed during the first operational cycle. The method further includes calculating a speed error by determining the difference between the first rotation speed demand and the actual rotation speed at predetermined points in at least one tub revolution of the first operational cycle and determining the range of speed errors. The tub rotation is affected in response to the range of speed errors.

In a still further aspect of the invention, a clothes washing machine includes a cabinet, a tub rotatably mounted within the cabinet, and a motor operably coupled to the tub for rotating the tub within the cabinet. The clothes washing machine further includes a memory storing a rotation speed demand value and a rotation speed detection device. A processor is programmed to detect an imbalance condition of the rotating tub, at least in part by comparing the tub rotation speed to the speed demand to calculate a speed error, determining minimum and maximum speed error values, and calculating the difference between the maximum and minimum speed error values. In a particular embodiment, the tub is oriented to rotate about a substantially horizontal axis. In another embodiment, the motor comprises a switched reluctance motor. In an alternative embodiment, the memory further stores a standard power level associated with a given rotation speed. The processor is programmed to calculate a power level required to achieve the given washing machine rotation speed indicated by the speed detection device, and compare the required power level to the predefined standard power level to detect a tub imbalance condition.

BRIEF DESCRIPTION OF THE DRAWINGS

Other objects and advantages of the invention will become apparent upon reading the following detailed description and upon reference to the drawings in which.

Figure 3:
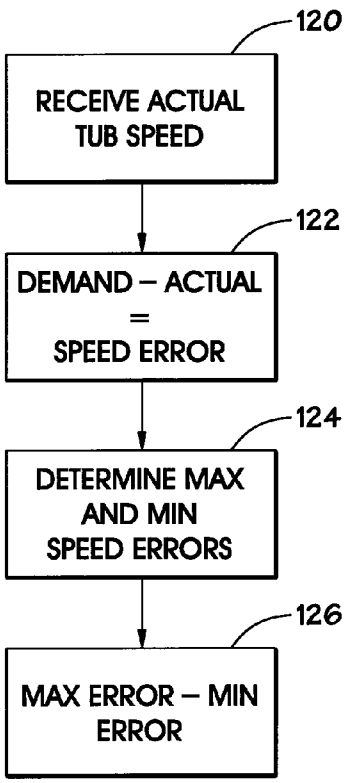
FIG. 3 is a flow diagram, illustrating a method for detecting a washing machine tub imbalance in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers'specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 1:
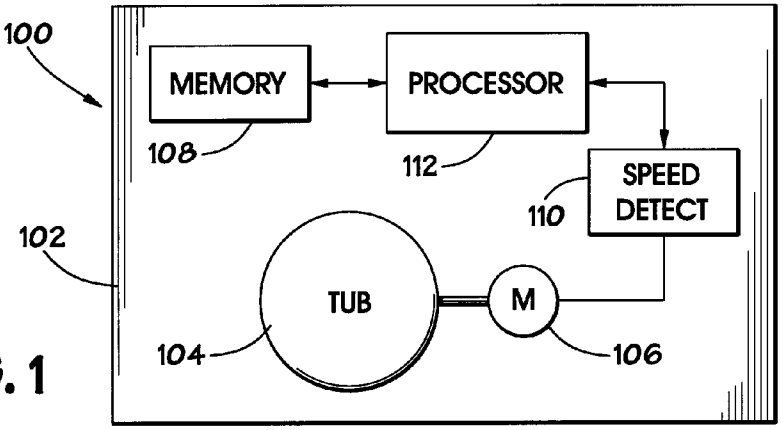
FIG. 1 is a block diagram, schematically illustrating a system for detecting a washing machine tub imbalance condition in accordance with an embodiment of the present invention.
Figure 2:
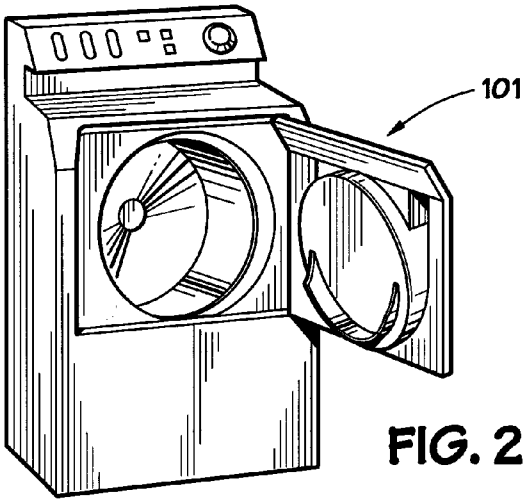
FIG. 2 is a perspective view of a horizontal-axis washing machine in accordance with an exemplary embodiment of the present invention.

FIG. 1 is a block diagram, schematically illustrating a washing machine 100 in accordance with an embodiment of the present invention. The washing machine 100 includes a cabinet 102, in which a tub 104 is rotatably mounted. In one embodiment of the invention, the washing machine 100 is a horizontal-axis washing machine. In other words, the tub 104 is configured to rotate about a substantially horizontal axis within the cabinet 102. FIG. 2 illustrates a horizontal-axis washing machine 101 in accordance with a specific embodiment of the invention.

Referring back to FIG. 1, a motor 106 is operably connected to the tub 104 to drive the tub 104, for example, via a belt. The machine 100 further includes a memory 108 that stores a rotation speed demand value. A speed detection device 110 is coupled to the motor 106 to ascertain the actual speed of the motor 106, and hence, the rotation speed of the tub 104. Alternatively, the speed detection device 110 may be coupled directly to the tub 104 to detect its rotation speed. In yet other embodiments, rotation speed of the motor 106 and thus, the 104 is determined without the use of sensors by monitoring electrical and magnetic parameters of the motor 106. An example of such sensorless operation is described in U.S. Pat. No. 5,701,064, assigned to the assignee of the present application, which is incorporated by reference in its entirety.

A processor 112 is programmed to detect an imbalance condition of the rotating tub 104, based at least in part upon the difference between the actual rotation speed of the tub 104 (as detected by the device 110) and the speed demand stored in the memory 108. In an embodiment of the invention, the processor 112 is programmed according to the method illustrated in FIG. 3 to determine the out of balance condition of the tub 104. Referring to the flow diagram of FIG. 3, an indication of the actual rotation speed of the tub 104 is received in block 120. In block 122, a speed error is calculated by comparing the actual rotation speed, as determined in block 120, to the speed demand stored in the memory 108. In other words, the actual rotation speed is subtracted from the speed demand to obtain the speed error.

In block 124, the maximum and minimum speed errors are determined. In particular embodiments, this is done for each revolution of the tub 104. In block 126, the difference between the maximum and minimum speed errors is calculated to determine the out of balance condition. The difference between the maximum and minimum speed errors calculated in block 126 provides an indication of the degree that the tub 104 is out of balance; the greater the difference between the maximum and minimum speed errors, the greater the imbalance of the tub 104.

Figure 4:
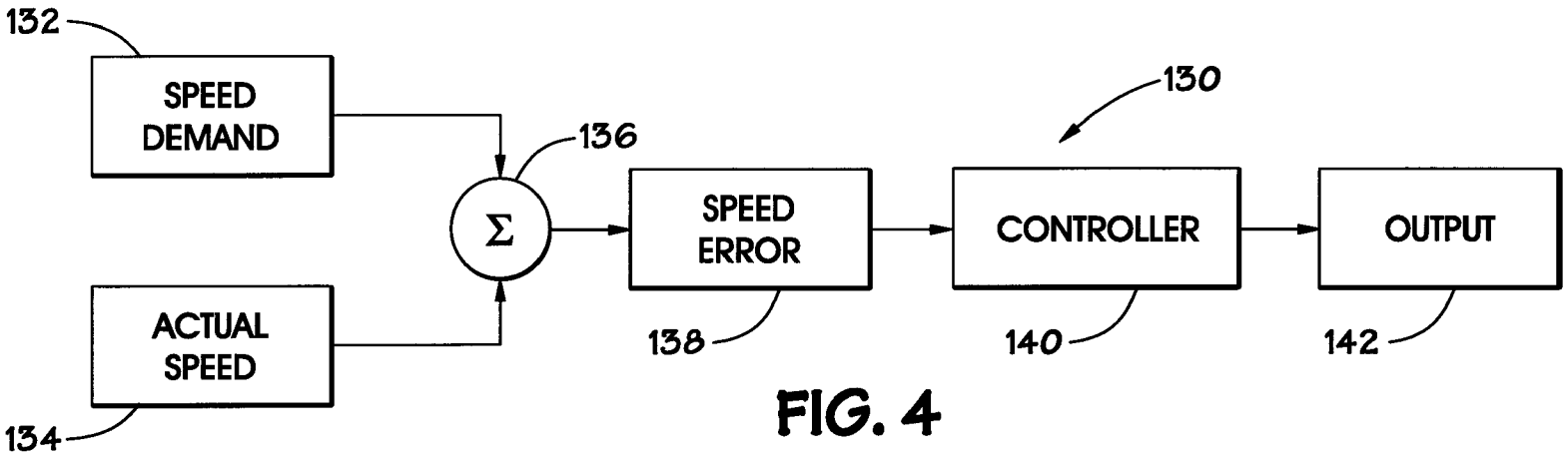
FIG. 4 is a block diagram illustrating a speed control loop in accordance with an embodiment of the present invention.

In an exemplary embodiment of the invention, the washing machine 100 includes a controller that controls the rotation speed of the tub 104. FIG. 4 illustrates a speed control loop 130 used in an embodiment of the invention. The speed demand 132, as stored in the memory 108, is compared to the actual rotation speed 134, as indicated by the device 110, at a summation point 136 to produce a speed error 138. The speed error 138 is input to a controller 140, which produces an output 142 that is applied to the motor 106 to correct the speed error 138. The controller 140 is effective in keeping the speed error small. Thus, the minimum and maximum output 142 of the controller 140 may be used to detect an imbalance condition.

Figure 5:
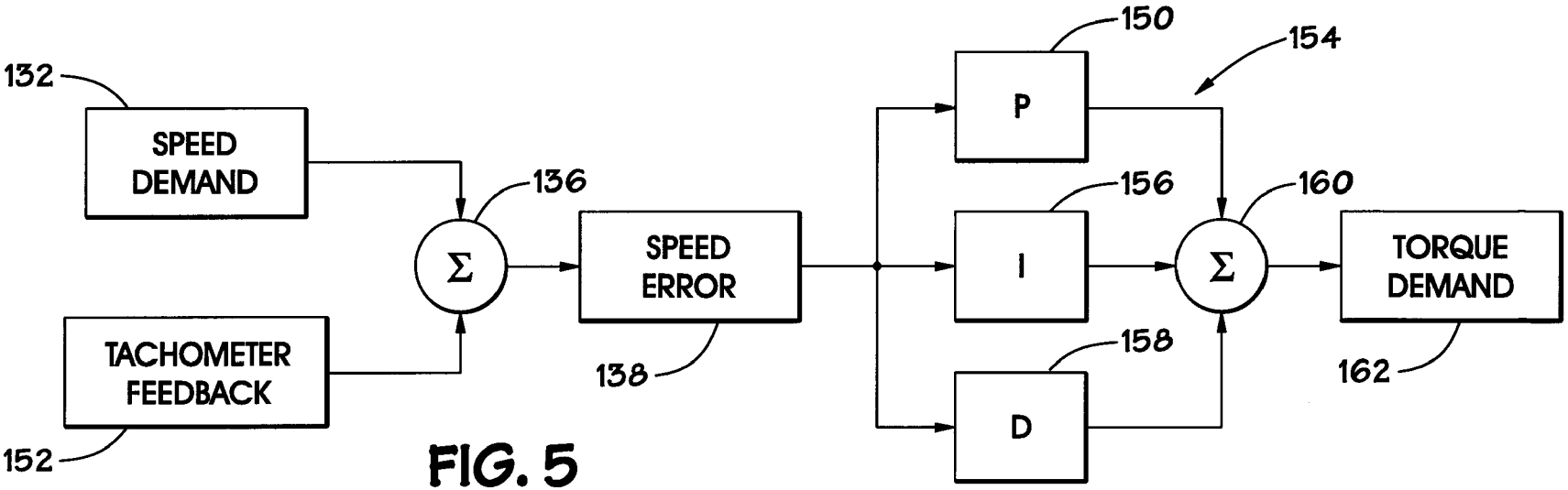
FIG. 5 is a specific embodiment of the speed control loop of FIG. 4.

FIG. 5 illustrates a proportional-integral-derivative (PID) speed control loop 150, which is employed in a specific embodiment of the invention. The speed control loop 150 is implemented in software via the processor 112, which, in this exemplary embodiment, comprises a microcontroller. A Motorola model MC68HC05P9 microcontroller is a suitable processor. The Motorola model MC68HC05P9 microcontroller includes on-chip memory; therefore, the memory 108 is contained within the processor 112.

In an embodiment employing the PID speed control loop 150 shown in FIG. 5, the motor 106 comprises a switched reluctance motor, as is known in the art. A reluctance motor is an electric machine in which torque is produced by the tendency of a movable part to move to a position where the inductance of an energized winding is maximized (i.e., the reluctance is minimized). The switched reluctance motor is generally constructed without conductive windings or permanent magnets on the rotating part (called the rotor) and includes electronically-switched windings carrying unidirectional currents on the stationary part (called the stator). Commonly, pairs of diametrically opposed stator poles may be connected in series or parallel to form one phase of a potentially multi-phase switched reluctance motor.

Motoring torque is developed by applying voltage to each of the phase windings in a predetermined sequence that is synchronized with the angular position of the rotor so that a magnetic force of attraction results between poles of the rotor and stator as they approach each other. Thus, in a switched reluctance machine, a rotor position detector is typically employed to supply signals corresponding to the angular position of the rotor, such that the phase windings may be properly energized as a function of the rotor position.

The rotor position detector may take many forms. In some systems, the rotor position detector can comprise a rotor position transducer that provides output signals that change state each time the rotor rotates to a position where a different switching arrangement of the devices in the power converter is required. In other systems, the rotor position detector can comprise a relative position encoder that provides a pulse (or similar signal) each time the rotor rotates through a preselected angle.

In an embodiment of the present invention employing a switched reluctance motor, the output of the rotor position detector functions as a tachometer that generates a speed feedback signal 152, indicating the motor 106 speed, and thus, the rotation speed of the tub 104. In an exemplary speed detection system, the rotor position sensor for the motor 106 provides 48 pulses per revolution of the motor 106. The rotor position sensor's 48 pulses per revolution are divided down by the controller chip (not shown) for the motor 106 to eight pulses per revolution. These eight pulses are provided to the processor 112. The washing machine employs a belt drive for rotating the tub 104, with the system having a 12:1 belt ratio. Thus, there are 96 tachometer pulses per revolution of the tub 104 provided to the processor 112. The present invention, however, is not limited to a speed detection such as this. A person having ordinary skill in the art could determine actual tub rotation speed using approaches other than a tachometer. For example, in another exemplary embodiment employing a sensorless switched reluctance motor, eight pulses per revolution are provided based on motor speed determined by examining motor parameters. In embodiments using an induction motor to drive the tub 104, slip may be examined to determine speed.

The tachometer feedback 152, indicating actual speed, is compared to the speed demand 132 at the summation point 136 to produce the speed error 138. The speed error 138 is applied to the controller's proportional 154, integral 156 and derivative 158 modes, and the PID action is summed at a summation point 160. The output of the controller is a torque demand 162 required to correct the speed error 138. The controller 140 is effective at keeping the speed error 138 signal small. The controller 140 output is such as to counteract the tendency of the speed to change. Then the difference between the minimum and maximum of the controller 140 output indicates the imbalance directly.

In other embodiments, each of the proportional 154, integral 156 and derivative 158 control modes are not utilized in the speed control loop 150. For instance, it would be a routine undertaking for one skilled in the art having the benefit of this disclosure to implement the invention using only proportional control action.

Figure 6:
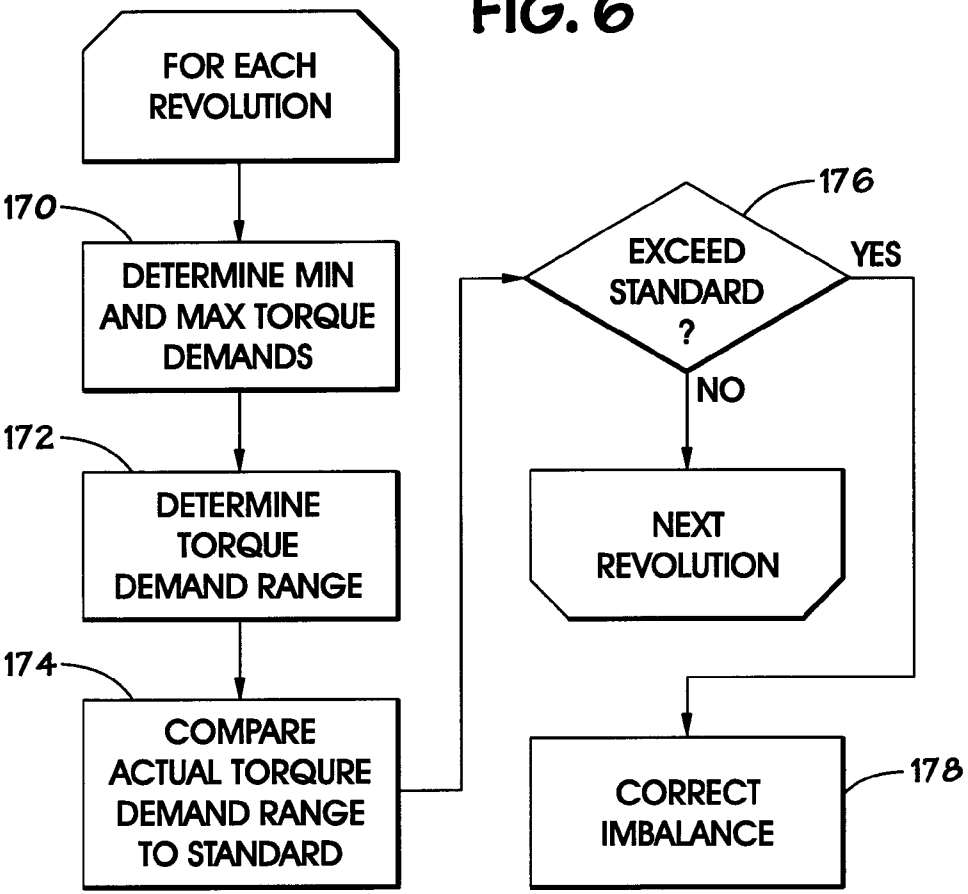
FIG. 6 is a flow diagram illustrating an embodiment of a method in accordance with the present invention.

FIG. 6 illustrates an exemplary method, used with an embodiment employing a speed control loop as shown in FIG. 5. During each revolution of the washing machine tub 104, each torque demand signal 162 is captured and compared to determine the minimum and maximum torque demands 162 in block 170. The range of torque demand signals 162 for each revolution of the tub 104 is determined in block 172 by subtracting the minimum torque demand 162 from the maximum torque demand 162. In alternative embodiments, the minimum and maximum torque demand are not determined during each tub revolution, but rather, during some preselected revolutions, for example, every-other revolution, or every half revolution. In still further embodiments, the minimum and maximum torque demand may be determined periodically, for example, at predetermined time intervals.

The memory 108 contains a predetermined standard torque demand range, to which the difference between the minimum and maximum torque demand is compared to the standard torque demand range in block 174 during distribution. In decision block 176, the processor 112 determines whether the actual range exceeds the standard. If the actual range is within the standard, operation continues. If the actual range exceeds the standard, corrective action may then be taken in block 178. For example, if the actual torque demand range exceeds the standard, the clothes can be retumbled, then the distribution cycle may be restarted. This often corrects the imbalance. Alternatively, the distribution ramp may be modified to better balance the tub 104.

Moreover, since the minimum and maximum torque demands are determined at a plurality of angular locations based on the tachometer feed back 152, the position of the tub 104 imbalance may be determined. For instance, information relating to the angular position of the minimum and maximum torque demands and the torque demand range, for a given load, may be empirically correlated to angular positions of load imbalances. These relationships may be provided in a look-up table stored in the memory 108 and accessed by the processor 112 to implement corrective action at the specific imbalance location. This may be necessary, for example, if the tub as produced is not balanced. It should be noted that using the output 142 or torque demand 162 to determine imbalance may cause a phase shift in the estimated position of an imbalance. One skilled in the art, however, could compensate for this phase shift via knowledge of the controller time constants and other controller parameters.

As discussed in the Background of the Invention section herein above, washing machines typically include a variety of operation cycles. Washing machines—particularly horizontal-axis machines—include one or more wash cycles, distribution cycles and spin cycles. The above described method of detecting imbalance may be employed during any washing machine cycle, though tub imbalance is rarely a problem during wash cycles, which, in a horizontal-axis machine, use a tub rotation speed of about 50 rpm to tumble the clothes in and out of the water. The method described in conjunction with FIG. 3 and FIG. 5 is particularly well suited for distribution cycles, which typically operate at a tub rotation speed of about 55–110 rpm (clothes will begin to "stick" to the sides of the tub 104 at about 60 rpm).

In comparison, the minimum rotation speed that is normally considered a "spin cycle" speed is about 250 rpm. In a particular embodiment of the invention, a tub rotation speed of about 350–450 is considered a "low" spin speed, a tub rotation speed of about 650–850 is considered a "medium" spin speed, and about 1,000 rpm is considered "high" spin speed. As discussed above, it is desirable to rotate the tub 104 at a high speed to extract the maximum amount of water from the clothes. At the high tub rotation speeds of a spin cycle, it may be difficult to implement the method illustrated in FIG. 3 or FIG. 5, depending on the processing speed and power available.

Figure 7:
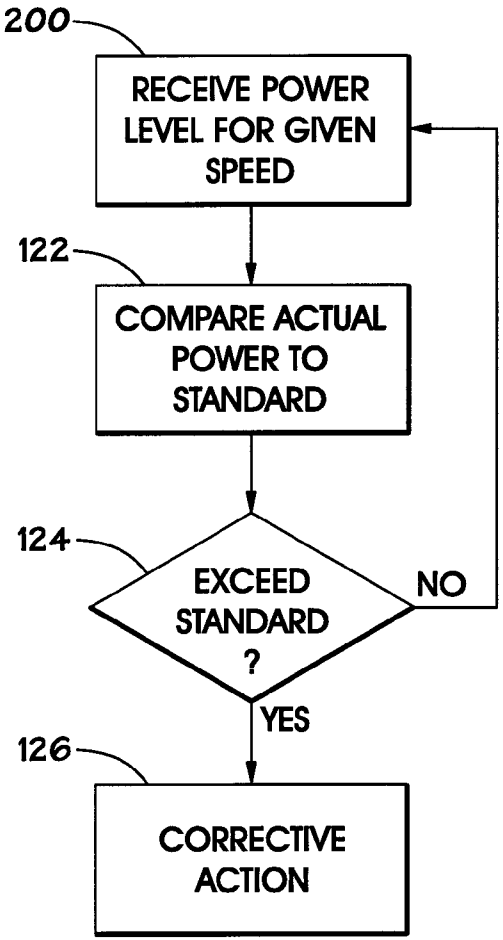
FIG. 7 is a flow diagram illustrating an alternative method in accordance with the invention for detecting and correcting a washing machine tub imbalance condition.

FIG. 7 illustrates another method in accordance with the present invention for detecting washing machine tub imbalance. The embodiment illustrated in FIG. 7 is especially suited for use with the high rotation speeds of a spin cycle, though the method may be applied to other cycles, such as a wash cycle. In block 200, an indication of the power required to achieve a given tub rotation speed is received. In a particular embodiment, the power level indication is obtained during the tub's 104 acceleration. In block 202, the power level received in block 200 is compared to a predetermined "normal" power level or power level range required for achieving the demanded speed with a given load. As shown in decision block 204, if the actual power level exceeds the standard power level for the given speed demand, corrective action is taken in block 206. If the actual power does not exceed the standard power level, the system continues to operate.

Figure 8:
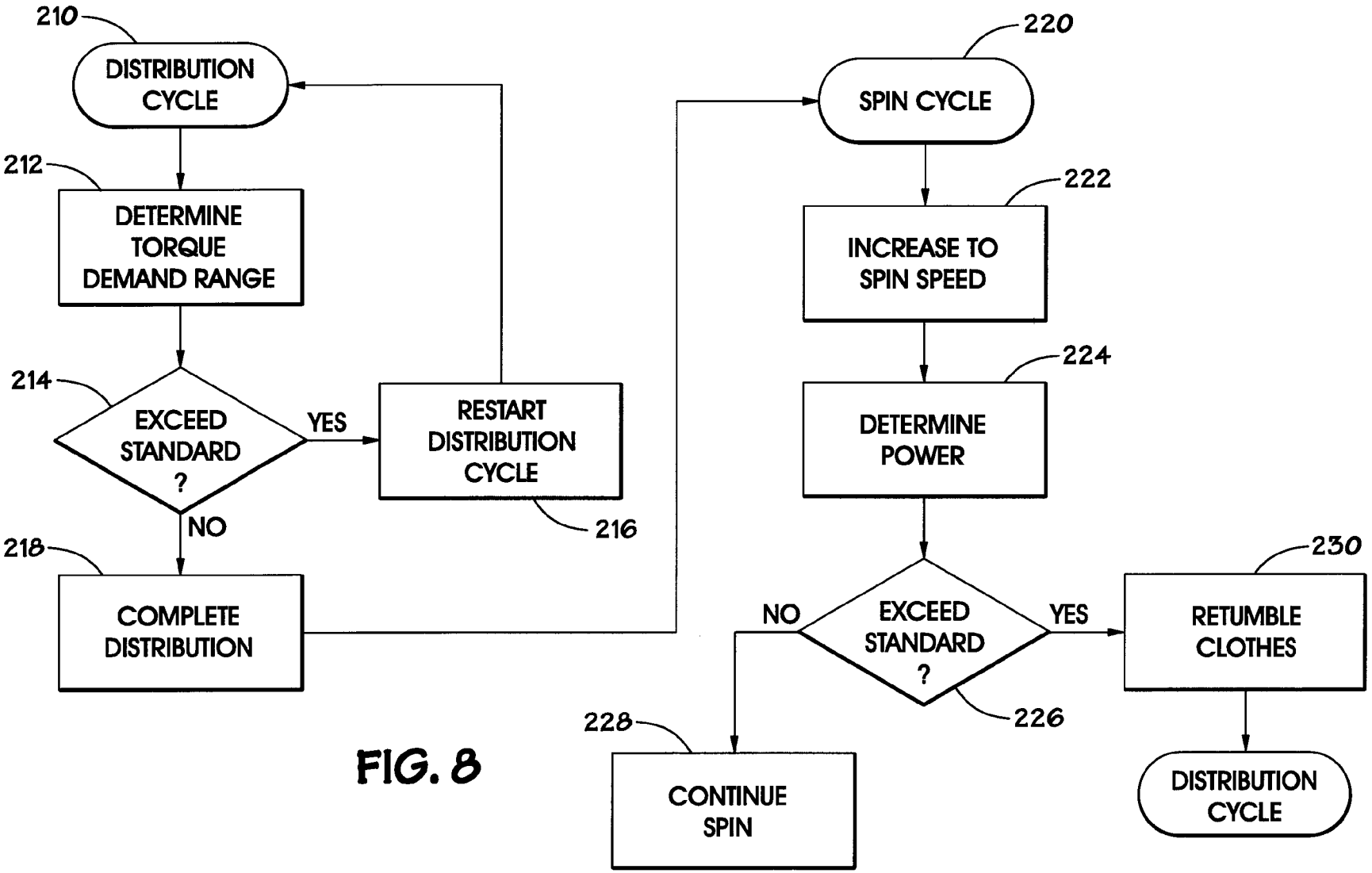
FIG. 8 is a flow diagram illustrating a method of controlling a washing machine in accordance with the present invention.

FIG. 8 illustrates a method for controlling a washing machine in accordance with an embodiment of the invention. In this exemplary embodiment, the washing machine is a horizontal-axis machine that includes at least first and second cycles, which may comprise distribution and spin cycles, respectively. For distribution cycles, wherein the tub rotation speed is gradually increased until the clothes "stick" to the sides of the tub, a process essentially as illustrated in FIG. 5 is used to detect a tub imbalance condition. For spin cycles, wherein the tub is rotated at a high speed to extract water from the clothes, a process along the lines illustrated in FIG. 7 is used.

In block 210, a distribution cycle is initiated. The minimum torque demand 162, as output by the PID control loop 150, is subtracted from the maximum torque demand to determine the torque demand range in block 212. In decision block 214, the torque demand range is compared to a predetermined standard torque demand, and if the torque demand range exceeds the standard, corrective action is taken. In one embodiment, the clothes are retumbled and the distribution cycle is then restarted, illustrated in block 216. If the torque demand range does not exceed the standard, the distribution cycle continues until the clothes are distributed about the sides of the tub 104, illustrated in block 218.

When the clothes are properly distributed, the spin cycle begins (block 220) by increasing the rotation speed of the tub 104 to the desired spin speed in block 222. In block 224, the average torque demand 162 is monitored at various speeds to determine power. Power is monitored in order to determine if excess power is required for a given spin speed with a given load. In decision block 226, the power for the given speed is compared to a standard, or "normal" power level for the given speed. If the actual power exceeds the standard, power is being wasted in tub 104 vibration, rather than being provided to the load. Thus, if the actual power does not exceed the standard, the spin cycle continues in block 228. If the actual power exceeds the standard in decision block 226, corrective action is taken. In this exemplary embodiment, the clothes are retumbled at a wash speed in block 230, and the distribution cycle is repeated. Other corrective actions may be used in alternative embodiments; for instance, reducing the spin speed. Since some embodiments in accordance with the invention disclosed herein use the output of the controller 140, the imbalance condition may be determined at any point during a particular washing machine cycle. It is not necessary for the tub 104 to be rotating "at speed"—the desired distribution or spin cycle speed—to implement the methods of the present invention. Rather, an imbalance condition may be detected at any point after the tub 104 begins rotating. Still further, the actual speed may be compared to any preselected speed demands 132. This allows the imbalance condition to be detected and corrected as soon as possible in the cycle, reducing wasted energy and other problems associated with imbalance conditions.

It will be appreciated by those of ordinary skill in the art having the benefit of this disclosure that the embodiment illustrated above is capable of numerous variations without departing from the scope and spirit of the invention. It is fully intended that the invention for which a patent is sought encompasses within its scope all such variations without being limited to the specific embodiment disclosed above. Accordingly, the exclusive rights sought to be patented are as described in the claims below.

What is claimed is:

1. A method of detecting an imbalance condition in a rotating washing machine tub, the method comprising:

receiving an indication of the actual tub rotation speed;

comparing the actual tub rotation speed to a predetermined desired rotation speed to calculate a speed error;

determining maximum and minimum speed errors;

calculating the difference between the maximum and minimum speed error; and detecting a tub imbalance condition based on the calculated difference.

2. The method of claim 1, wherein detecting a tub imbalance condition based on the calculated difference includes:

comparing the difference between the maximum and minimum speed errors to a predetermined limit; and detecting the tub imbalance condition in respects to the comparison.

3. The method of claim 1, wherein the imbalance condition is detected during a washing machine cycle selected from at least one of a wash cycle, a distribution cycle and a spin cycle.

4. The method of claim 1, wherein the maximum and minimum speed errors are determined during a predetermined number of washing machine tub revolutions.

5. The method of claim 4, wherein the predetermined washing machine tub revolutions comprise each washing machine tub revolution.

6. The method of claim 4, wherein the predetermined washing machine tub revolutions comprise each half of a washing machine tub revolution.

7. The method of claim 1, wherein receiving an indication of the actual tub rotation speed comprises receiving feedback from a tachometer.

8. The method of claim 1, wherein comparing the actual tub rotation speed to a predetermined desired rotation speed comprises comparing the actual tub rotation speed to a preselected one of a plurality of predetermined desired rotation speeds.

9. The method of claim 1, further comprising:

applying the speed error to a controller that provides an output signal;

wherein determining the maximum and minimum speed errors comprises determining the maximum and minimum controller output signals.

10. The method of claim 1, further comprising determining an angular location of the imbalance condition.

11. A method of detecting an imbalance condition in a rotating washing machine tub, the method comprising:

receiving an indication of the actual tub rotation speed;

comparing the actual tub rotation speed to a predetermined desired rotation speed to calculate a speed error;

applying the speed error to a controller that provides an output signal;

determining maximum and minimum controller output signals; and detecting a tub imbalance condition based at least in part on the difference between the maximum and minimum controller output signals.

12. A system for detecting an imbalance condition for a rotating washing machine tub, comprising:

a processor;

a memory accessible by the processor and storing a rotation speed demand value; and a speed detection device adapted to provide an indication of the detected actual tub rotation speed to the processor;

the processor being programmed to compare the actual tub rotation speed to the speed demand to calculate a speed error, determine minimum and maximum speed error, and calculate the difference between the maximum and minimum speed errors to detect an imbalance condition.

13. The system of claim 12, wherein the memory stores a predetermined speed error limit; wherein the processor is programmed to compare the difference between the maximum and minimum speed errors to the predetermined limit.

14. The system of claim 12, wherein the processor is programmed to determine the minimum and maximum speed error values during a predetermined number of tub revolutions.

15. The system of claim 14, wherein the processor is programmed to determine the minimum and maximum speed error values during each revolution of the tub.

16. The system of claim 14, wherein the processor is programmed to determine the minimum and maximum speed error values during each half-revolution of the tub.

17. The system of claim 2, wherein the speed detection device comprises a tachometer.

* * * * *